US008028362B1

(12) United States Patent
Barreau et al.

(10) Patent No.: US 8,028,362 B1
(45) Date of Patent: Oct. 4, 2011

(54) TOE PROTECTING BED FRAME ACCESSORY

(76) Inventors: Fred Barreau, Medford, MA (US); Neerja Barreau, Medford, MA (US)

( * ) Notice: Subject to any disclaimer, the term of this patent is extended or adjusted under 35 U.S.C. 154(b) by 0 days.

(21) Appl. No.: 12/946,641

(22) Filed: Nov. 15, 2010

(51) Int. Cl.
*A47C 31/00* (2006.01)

(52) U.S. Cl. ..... 5/663; 5/907; 248/345.1; D8/403

(58) Field of Classification Search ..... 5/663, 739, 5/493, 907; 16/18 CG; 248/345.1; 108/27; D8/402, 403
See application file for complete search history.

(56) References Cited

U.S. PATENT DOCUMENTS 4,117,782 A 10/1978 Cahill
4,323,610 A 4/1982 Leverich
5,322,257 A * 6/1994 Verderose et al. ..... 248/345.1
5,508,078 A * 4/1996 Stalnaker ..... 428/71
6,125,488 A * 10/2000 Vogland et al. ..... 5/739
6,353,951 B1 3/2002 Gramling
6,418,578 B1 7/2002 Polevoy et al.
6,647,589 B1 11/2003 Youngwith
D557,598 S 12/2007 Hoelting
7,338,024 B2 * 3/2008 Chen et al. ..... 248/345.1
2007/0220680 A1 * 9/2007 Miller et al. ..... 5/739
2009/0189045 A1 * 7/2009 Peckovich ..... 248/345.1

* cited by examiner

*Primary Examiner* — Michael Trettel
(74) *Attorney, Agent, or Firm* — Kyle Fletcher

(57) ABSTRACT

The toe protecting bed frame accessory includes an angled brace formed of two sides that meet at a spine to form a right angle therein. The two sides each have curved steps that descend from a top corner at the spine down to the floor at opposing ends. The accessory features a plurality of adjustable straps that enable the accessory to be secured about different corners of a bed frame. The sides of the accessory are filled with a soft material that prevents painful foot and toe jams when kicked against the bed frame. The sides of the accessory are upholstered in a fabric that matches a bedspread or window treatment within the same room.

18 Claims, 3 Drawing Sheets

FIG. 1
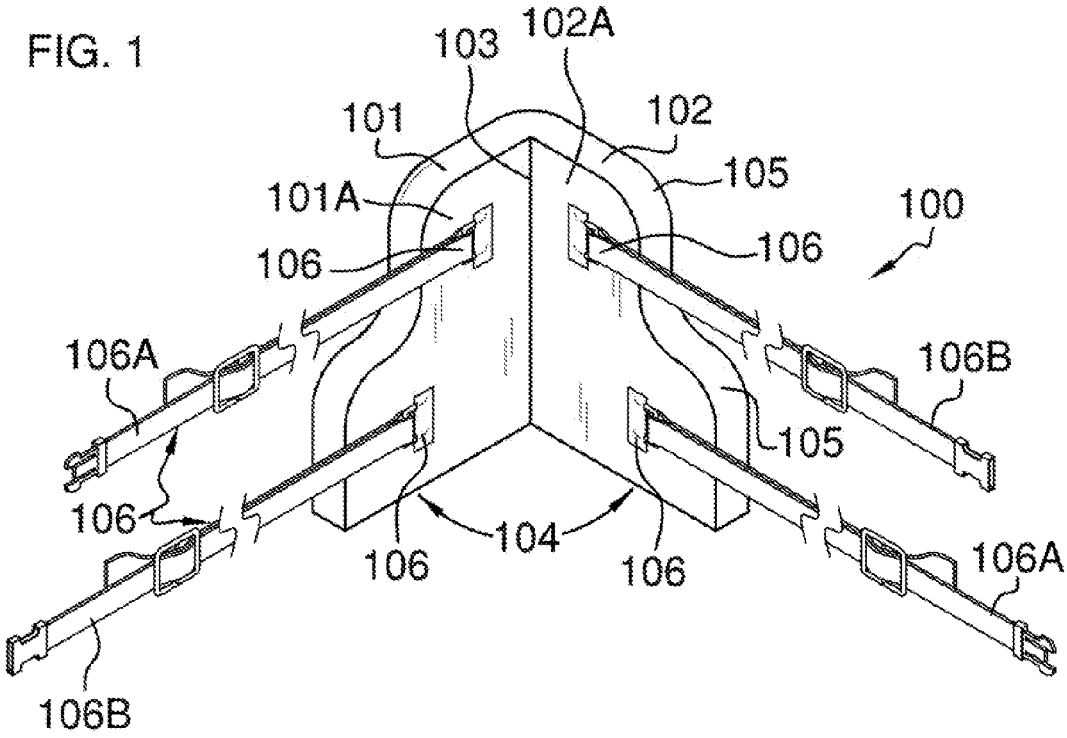
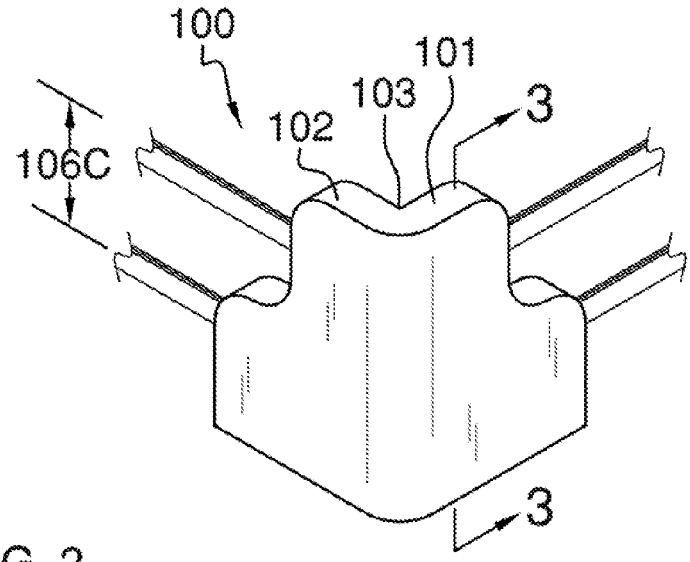
FIG. 2

TOE PROTECTING BED FRAME ACCESSORY

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

A. Field of the Invention

The present invention relates to the field of bedroom accessories, more specifically, a bed frame accessory that protects against toe jams associated with kicking the bed frame when walking around the bed.

Bed frames that support box springs and mattresses are useful in elevating the bed to a desired height. However, the bed frames can be made out of hard materials, which can hurt when a person jams his or her toe against said frame while walking around a bed in either a lighted or poorly lit bedroom.

The present invention seeks to improve upon this dilemma by providing a stylized accessory that attaches onto the corners of bed frames and of which provides a padded protector that prevents toe jams when impacted by the feet of an end user. Even more particularly, the present invention can be upholstered with fabrics that are identical to or match a bed spread of the actual bed, carpet of the bedroom, or drapes or window treatments in the bedroom.

B. Discussion of the Prior Art

As a preliminary note, it should be stated that there is an ample amount of prior art that deals with bed frames. As will be discussed immediately below, no prior art discloses a bed frame accessory that is comprised of an angled brace that is filled with a soft material that prevents pain when impacted by a toe or foot of an end user; wherein the accessory is for use with each corner of a bed frame; wherein the accessory may be upholstered with fabric matching the bed spread or window treatments of the room therein; wherein the accessory includes a plurality of adjustable straps that secures the accessory around a corner of said bed frame; wherein the angled brace forms a right angle along a spine and from which two sides extend away; wherein the two sides have angled steps along such that the sides extend from a top along the spine down to the ground at ends farthest from said spine.

The Leverich Patent (U.S. Pat. No. 4,323,610) discloses a protective device which encircles the legs and feet of furniture to protect people from incidental foot and toe impacts. However, the device is designed to wrap around a leg or foot of furniture by forming a cylinder as opposed to an angled brace.

The Gramling Patent (U.S. Pat. No. 6,353,951) discloses a cushioning cover wrapped around a bed frame leg to absorb a striking blow imposed on it by a person's toe or toes. However, the cushioning cover is not an angled brace that is upholstered in fabrics designed to match the bed spread or window treatments.

The Cahill Patent (U.S. Pat. No. 4,117,782) discloses an elongate guard for preventing injury to humans on striking edges of furnishings. However, the elongated guard is not designed for use with a bed frame and involve an angular brace upholstered in fabric that matches a bed spread.

The Youngwith Patent (U.S. Pat. No. 6,647,589) discloses a furniture leg pad of impact absorbing material adapted to be wrapped around a furniture leg which protects the leg or human feet from damage. However, the pad is not angularly-shaped brace that is upholstered in fabrics that match the bed spread, or adaptable for differently-shaped bed frames via adjustable straps.

The Polevoy et al. Patent (U.S. Pat. No. 6,418,578) discloses a protective guard adapted for use with a bed frame leg. However, the guard is limited in terms of the available area of coverage that exists beneath a bed frame, and is not an angled brace that can protect the bed frame and above.

The Hoelting Patent (U.S. Pat. No. Des. 557,598) illustrates a design for a bed frame leg protector, which does not resemble an angled brace having sides with steps and curves descending from an apex along a spine down to a bottom at opposing ends.

While the above-described devices fulfill their respective and particular objects and requirements, they do not describe a bed frame accessory that is comprised of an angled brace that is filled with a soft material that prevents pain when impacted by a toe or foot of an end user; wherein the accessory is for use with each corner of a bed frame; wherein the accessory may be upholstered with fabric matching the bed spread or window treatments of the room therein; wherein the accessory includes a plurality of adjustable straps that secures the accessory around a corner of said bed frame; wherein the angled brace forms a right angle along a spine and from which two sides extend away; wherein the two sides have angled steps along such that the sides extend from a top along the spine down to the ground at ends farthest from said spine. In this regard, the toe protecting bed frame accessory departs from the conventional concepts and designs of the prior art.

SUMMARY OF THE INVENTION

The toe protecting bed frame accessory includes an angled brace formed of two sides that meet at a spine to form a right angle therein. The two sides each have curved steps that descend from a top corner at the spine down to the floor at opposing ends. The accessory features a plurality of adjustable straps that enable the accessory to be secured about different corners of a bed frame. The sides of the accessory are filled with a soft material that prevents painful foot and toe jams when kicked against the bed frame. The sides of the accessory are upholstered in a fabric that matches a bedspread or window treatment within the same room.

An object of the invention is to provide an accessory for a bed frame that attaches itself around each corner of the bed frame to provide a cushion for preventing impacts with toes or feet of an end user.

A further object of the invention is to provide an accessory that is upholstered in fabric designed to match a bedspread or window treatments within a bedroom.

A further object of the invention is to provide an angled brace that can fit around a corner of a bed and bed frame and provide a height of coverage that extends away and beyond the bed frame to provide a greater extent of protection for an end user.

A further object of the invention is to provide an accessory that includes a plurality of adjustable straps along an inner surface of the angled brace that enables the accessory to be attached to bed frames of varying sizes and geometries.

These together with additional objects, features and advantages of the toe protecting bed frame accessory will be readily apparent to those of ordinary skill in the art upon reading the following detailed description of presently preferred, but nonetheless illustrative, embodiments of the toe protecting bed frame accessory when taken in conjunction with the accompanying drawings.

In this respect, before explaining the current embodiments of the toe protecting bed frame accessory in detail, it is to be understood that the toe protecting bed frame accessory is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the toe protecting bed frame accessory.

It is therefore important that the claims be regarded as including such equivalent construction insofar as they do not depart from the spirit and scope of the toe protecting bed frame accessory. It is also to be understood that the phraseology and terminology employed herein are for purposes of description and should not be regarded as limiting.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention:

In the drawings:

FIG. 1 illustrates a rear, isometric view of the toe protecting bed frame accessory by itself and with brakes in the adjustable straps to indicate that the straps are of an undefined length;

FIG. 2 illustrates a front, isometric view of the toe protecting bed frame accessory by itself and depicting the curved front edge that forms a 90 degrees turn for use about one of the corners of a bed frame;

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Figure 3:
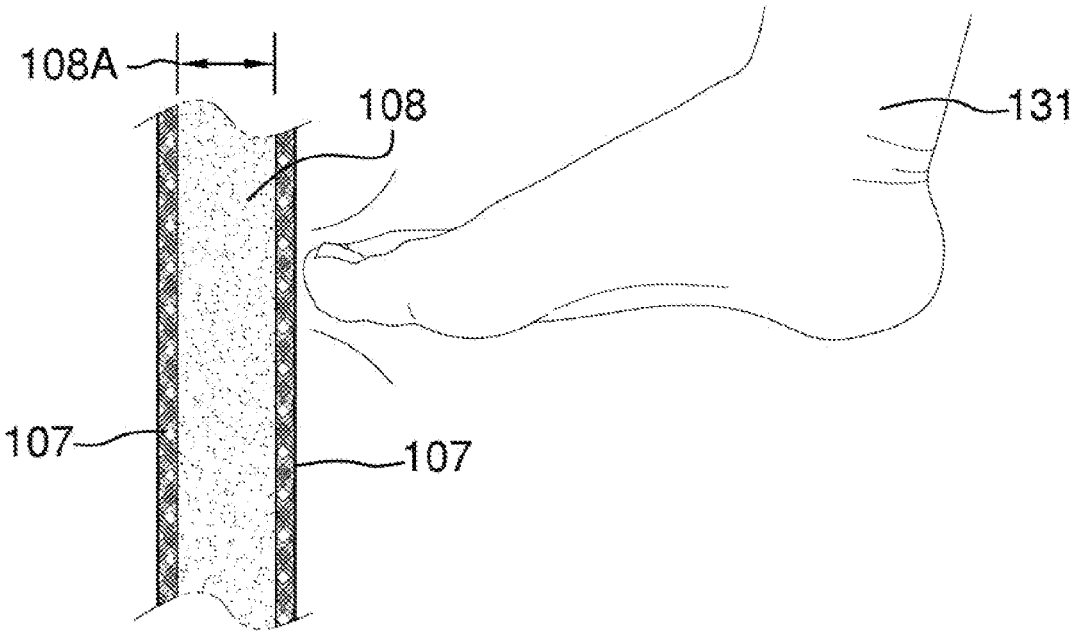
FIG. 3 illustrates a cross-sectional view of the toe protecting bed frame accessory along line 3-3 in FIG. 2, which depicts the various layers of the accessory.
Figure 4:
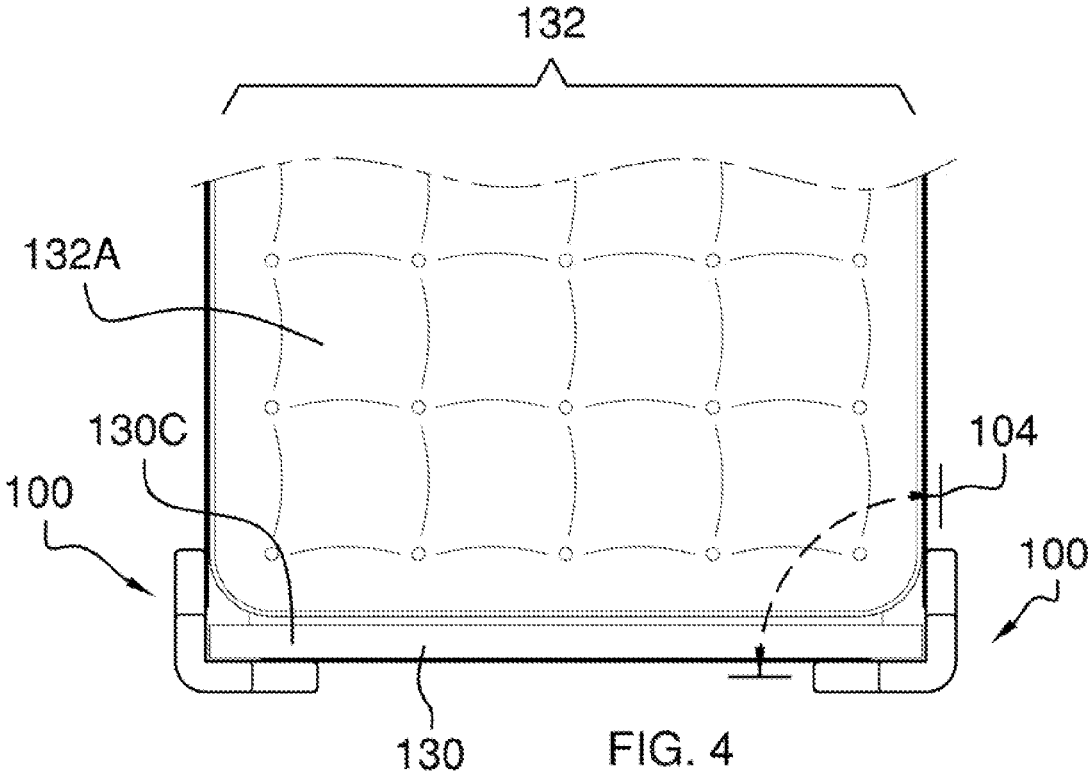
FIG. 4 illustrates a top view of the toe protecting bed frame accessory installed upon the two front corners of a bed.
Figure 5:
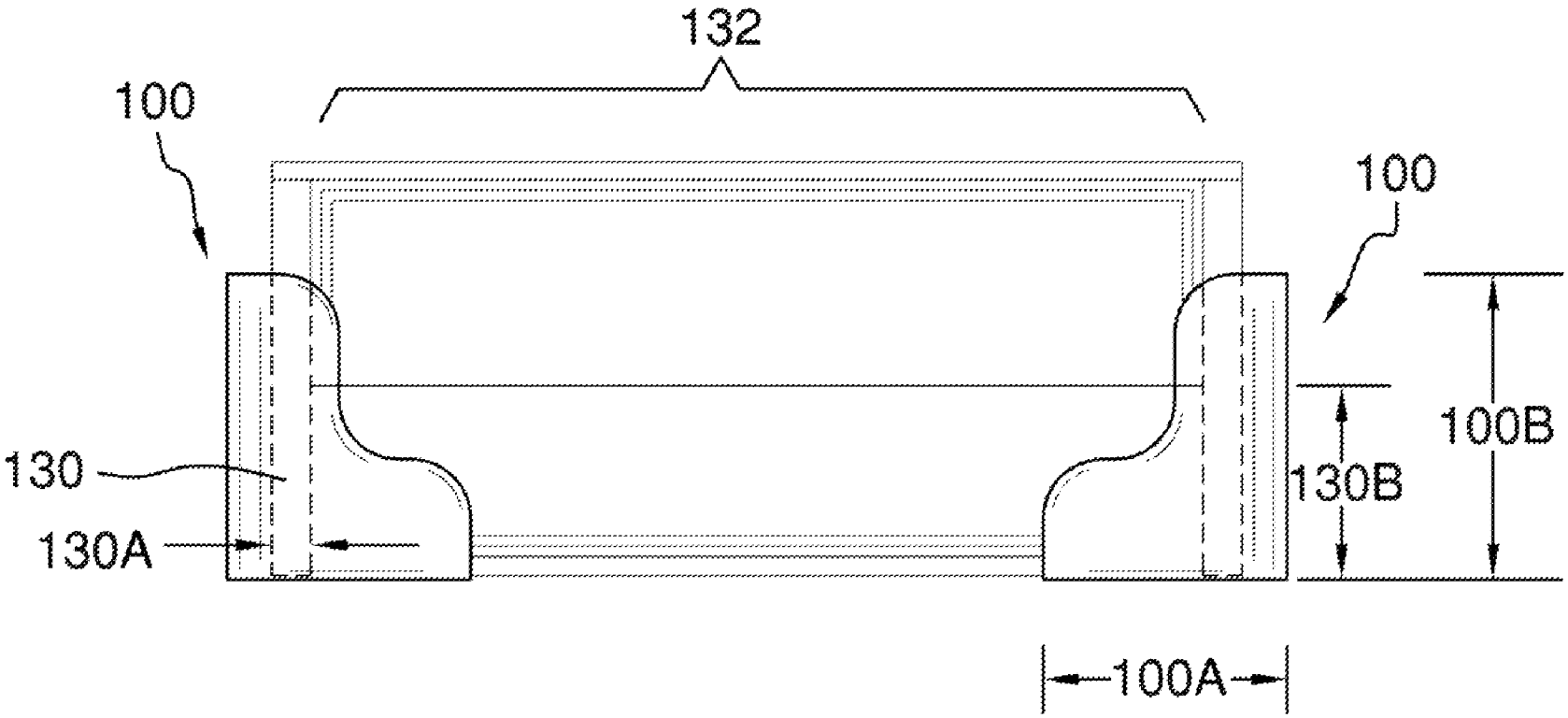
FIG. 5 illustrates a front view of the toe protecting bed frame accessory installed upon the two front covers of the bed.

Detailed reference will now be made to the preferred embodiment of the present invention, examples of which are illustrated in FIGS. 1-5. A toe protecting bed frame accessory 100 (hereinafter invention) includes an angled brace formed of a first side 101 and a second side 102 that meet to form a spine 103. The spine 103 forms a right angle 104 between the first side 101 and the second side 102.

The first side 101 and the second side 102 are designed to extend beyond an applicable width 130A and an applicable height 130B of a bed frame 130. A width 100A of the first side 101 and the second side 102 may range from four inches to two feet; whereas a height 100B of the first side 101 and the second side 102 may range from four inches to two feet. Both the first side 101 and the second side 102 each have curved steps 105 that extend along a width of the first side 101 and the second side 102. The curved steps 105 extend the area of coverage of the invention 100 well beyond the bed frame 130 in order to provide greater scope of protection.

The right angle 104 enables the invention 100 to fit snuggly against a corner 130C of the bed frame 130. The shape of the first side 101 and the second side 102 as well as the right angle 104 insure a proper fit at each corner 130C of the bed frame 130.

Located on an inner surface 101A of the first side 101 and an inner surface 102A of the second side 102 are a plurality of adjustable straps 106. The adjustable straps 106 are comprised of a first strap 106A and a second strap 106B. The first strap 106A buckles to a corresponding second strap 106B such that the invention 100 is secured about the corner 130C of the bed frame 130. Each side (either the first side 101 or the second side 102) has one of the first straps 106A and one of the second straps 106B. Also, located on each side (either the first side 101 or the second side 102) the first strap 106A is parallel 106C in orientation with the second strap 106B.

The first side 101 and the second side 102 are comprised of an outer layer of fabric 107, and an inner layer 108. The inner layer 108 is sandwiched between the outer layers of fabric 107 (see FIG. 3). The inner layer 108 is composed of a soft material that is ideal for impacts by a foot or toe of an end user 131. The inner layer 108 may be made of a stuffing used to fill pillows and the like, or may be made of a foam, such as a Visco-elastic foam. A thickness 108A of the inner layer 108 may range from one half inch to four inches in thickness. Obviously the greater the overall thickness of the inner layer 108 the greater the impact resistance of the invention 100.

The outer layer of fabric 107 may have a pattern identical to a bedspread 132A or other fabric in the area of a bed 132. The outer layer of fabric 107 may have an identical pattern to the bedspread such that the invention 100 matches the decorative aspect of the bed 132, and does not look like an after-market product.

With respect to the above description, it is to be realized that the optimum dimensional relationship for the various components of the invention 100, to include variations in size, materials, shape, form, function, and the manner of operation, assembly and use, are deemed readily apparent and obvious to one skilled in the art, and all equivalent relationships to those illustrated in the drawings and described in the specification are intended to be encompassed by the invention 100.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

The inventor claims:

1. A toe protecting bed frame accessory, further comprising:

an angled brace formed of a first side and a second side that meet to form a spine;

wherein both the first side and the second side each have curved steps that extend along a width of the first side and the second side;

wherein the spine forms a right angle between the first side and the second side;

wherein located on an inner surface of the first side and an inner surface of the second side are a plurality of adjustable straps, which secure the accessory to a corner of a bed frame;

wherein the first side and the second side are comprised of an outer layer of fabric, and an inner layer;

wherein the inner layer is sandwiched between the outer layers of fabric;

wherein the outer layer of fabric may have a pattern identical to a bedspread or other fabric in, the area of a bed.

2. The toe protecting bed frame accessory as described in claim 1 wherein the spine forms a right angle between the first side and the second side.

3. The toe protecting bed frame accessory as described in claim 1 wherein the first side and the second side are designed to extend beyond an applicable width as well as an applicable height of a bed frame.

4. The toe protecting bed frame accessory as described in claim 3 wherein a width of the first side and the second side may range from four inches to two feet.

5. The toe protecting bed frame accessory as described in claim 3 wherein a height of the first side and the second side may range from four inches to two feet.

6. The toe protecting bed frame accessory as described in claim 1 wherein the adjustable straps are comprised of a first strap and a second strap.

7. The toe protecting bed frame accessory as described in claim 6 wherein the first strap buckles to a corresponding second strap.

8. The toe protecting bed frame accessory as described in claim 7 wherein the first side and the second side each have one of the first straps and one of the second straps.

9. The toe protecting bed frame accessory as described in claim 8 whereupon on both the first side and the second side the first strap is parallel in orientation with the second strap.

10. The toe protecting bed frame accessory as described in claim 1 wherein the inner layer is composed of a soft material comprising a stuffing or a soft foam.

11. The toe protecting bed frame accessory as described in claim 10 wherein the inner layer has a thickness ranging from one half inch to four inches.

12. A toe protecting bed frame accessory, further comprising:

an angled brace formed of a first side and a second side that meet to form a spine, which is a right angle;

wherein the first side and the second side are designed to extend beyond an applicable width as well as an applicable height of a bed frame;

wherein both the first side and the second side each have curved steps that extend along a width of the first side and the second side;

wherein located on an inner surface of the first side and an inner surface of the second side are a plurality of adjustable straps, which secure the accessory to a corner of a bed frame;

wherein the first side and the second side are comprised of an outer layer of fabric, and an inner layer;

wherein the inner layer is sandwiched between the outer layers of fabric;

wherein the outer layer of fabric may have a pattern identical to a bedspread or other fabric in the area of a bed.

13. The toe protecting bed frame accessory as described in claim 12 wherein a width of the first side and the second side may range from four inches to two feet; and wherein a height of the first side and the second side may range from four inches to two feet.

14. The toe protecting bed frame accessory as described in claim 12 wherein the adjustable straps are comprised of a first strap and a second strap; wherein the first strap buckles to a corresponding second strap;

wherein the first side and the second side each have one of the first straps and one of the second straps; and whereupon on both the first side and the second side the first strap is parallel in orientation with the second strap.

15. The toe protecting bed frame accessory as described in claim 12 wherein the inner layer is composed of a soft material comprising a stuffing or a soft foam; and wherein the inner layer has a thickness ranging from one half inch to four inches.

16. A toe protecting bed frame accessory, further comprising:

an angled brace formed of a first side and a second side that meet to form a spine, which is a right angle;

wherein the first side and the second side are designed to extend beyond an applicable width as well as an applicable height of a bed frame;

wherein both the first side and the second side each have curved steps that extend along a width of the first side and the second side;

wherein located on an inner surface of the first side and an inner surface of the second side are a plurality of adjustable straps, which secure the accessory to a corner of a bed frame;

wherein the first side and the second side are comprised of an outer layer of fabric, and an inner layer;

wherein the inner layer is sandwiched between the outer layers of fabric;

wherein the outer layer of fabric may have a pattern identical to a bedspread or other fabric in the area of a bed;

wherein the adjustable straps are comprised of a first strap and a second strap; wherein the first strap buckles to a corresponding second strap; wherein the first side and the second side each have one of the first straps and one of the second straps; and whereupon on both the first side and the second side the first strap is parallel in orientation with the second strap.

17. The toe protecting bed frame accessory as described in claim 16 wherein a width of the first side and the second side may range from four inches to two feet; and wherein a height of the first side and the second side may range from four inches to two feet.

18. The toe protecting bed frame accessory as described in claim 16 wherein the inner layer is composed of a soft material comprising a stuffing or a soft foam; and wherein the inner layer has a thickness ranging from one half inch to four inches.

* * * * *